United States Patent [19]

Kennepohl et al.

[11] Patent Number: 5,033,230

[45] Date of Patent: Jul. 23, 1991

[54] METHOD FOR PASSIVATING PARTICULATE COAL

[75] Inventors: Gerhard J. A. Kennepohl, Oakville; Frank Souhrada, Islington, both of Canada

[73] Assignee: Alberta Research Council, Alberta, Canada

[21] Appl. No.: 161,878

[22] Filed: Feb. 29, 1988

Related U.S. Application Data

[63] Continuation of Ser. No. 927,828, Nov. 6, 1986, abandoned, which is a continuation-in-part of Ser. No. 810,061, Dec. 17, 1985, abandoned.

[30] Foreign Application Priority Data

Nov. 20, 1985 [CA] Canada ..... 495826

[51] Int. Cl.[5] ..... C10L 5/00

[52] U.S. Cl. ..... 44/502; 44/505; 44/545; 44/608; 44/628; 34/10

[58] Field of Search ..... 44/51, 61, 1 R, 10, 44/502, 505, 545, 608, 628; 34/9, 109

[56] References Cited

U.S. PATENT DOCUMENTS

| | | | |
|---|---|---|---|
| 2,590,733 | 3/1952 | Stillman | 44/51 |
| 2,610,115 | 9/1952 | Lykken | 44/33 |
| 2,811,427 | 10/1957 | Lykken | 44/10 |
| 3,957,456 | 5/1976 | Verschuur | 44/23 |
| 3,961,914 | 6/1976 | Kindig et al. | 44/1 R |
| 3,985,516 | 10/1976 | Johnson et al. | 44/1 R |
| 3,985,517 | 10/1976 | Johnson | 44/1 R |
| 4,214,875 | 7/1980 | Kromery | 44/6 |
| 4,397,653 | 8/1983 | Loganbach | 44/51 |
| 4,461,624 | 7/1984 | Wong | 44/1 R |
| 4,481,011 | 11/1984 | Weskamp et al. | 44/51 |

FOREIGN PATENT DOCUMENTS

| | | | |
|---|---|---|---|
| 56-0030466 | 3/1981 | Japan | 44/51 |
| 59-0140295 | 8/1984 | Japan | 44/51 |

*Primary Examiner*—Margaret B. Medley
*Attorney, Agent, or Firm*—Darby & Darby

[57] ABSTRACT

A method is disclosed for drying and passivating wet coals, for example bituminous, subbituminous or lignite. The wet coal is introduced into a heating zone at a controlled rate, then is contacted with a heavy hydrocarbonaceous treatment material having a softening point of at least 60° C. The particles and treatment material are simultaneously intimately mixed and are heated to a temperature of at least 200° C. but below the coal decomposition temperature while being moved along the heating zone in a plug flow manner. The particles are then cooled in a cooling zone.

16 Claims, 2 Drawing Sheets

METHOD FOR PASSIVATING PARTICULATE COAL

This is a continuation of co-pending application Ser. No. 927,828 filed on Nov. 6, 1986, now abandoned, which, in turn, is a continuation-in-part of Ser. No. 810,061 filed on Dec. 17, 1985, now abandoned.

The present invention relates to a method for treating wet particulate low-rank coal to produce a dried particulate coal-based fuel that is coated to prevent the reabsorption of moisture.

Coal, as mined from many deposits, contains a significant amount of moisture which results in both increased transportation costs from the coal deposit to the point of use, and decreased heat available from the coal when burned, because of the heat required to evaporate the moisture content. The problem exists in bituminous coals and is particularly acute with low-rank coals, for example subbituminous and lignite, which may contain from 10% to 50% moisture on an as-mined basis. Mere drying of the coals does not solve these problems entirely, because the dried coal tends to reabsorb moisture from the atmosphere and to approach its previous wet state. Indeed, a further problem is created when the heat released from the condensation of water vapour inside coal particles builds up to the point that spontaneous combustion is initiated, as has occurred on a number of occasions, thus causing serious fires. There is a need for a method to reduce the moisture content of these coals and to prevent moisture from being reabsorbed into the coal particles.

Many attempts have been disclosed by the prior art for drying coals and preventing the reabsorption of moisture into the dried coal. U.S. Pat. No. 3,961,914, Kindig et al. disclosed coating dried coal particles with silicon dioxide by introducing silicon tetrachloride gas and reacting it with water to produce a silicon dioxide film on the surface of the coal.

Johnson et al., in U.S. Pat. No. 3,985,516 disclosed the coating of subbituminous and lignite coal particles with heavy liquid hydrocarbon for example, crude oil residuum, in a fluidized bed after drying. The residuum could advantageously be diluted with a lighter carrier oil to improve the uniformity of the coating. Oxidation of the coal tends to occur during the drying stage of this process.

The same inventors in U.S. Pat. No. 3,985,517 disclosed the use of a fluidized bed process for simultaneously heating and coating coal particles with a heavy hydrocarbon liquid material. This process has the disadvantages of having to use a fluidized bed which is an expensive piece of equipment. Also, fluidized bed treatment results in uneven coating, and heating due to the random zones in the fluidized bed. Moreover, a fluidized bed cannot handle a wide distribution of particle sizes as the larger particles would not be fluidized and the smaller particles would be entrained in the gases and carried out of the bed. Dusting would be a further problem due to collisions of the fluidized particles in the bed.

In U.S. Pat. No. 4,192,650 Seitzer disclosed the prevention of autogenous heating by rehydrating the dried coal with steam at 100° C. to 115° C. to yield a moisture content of 2% to 10%.

Kromrey disclosed in U.S. Pat. No. 4,214,875 a coating composition to be applied to a pile of coal exposed to the weather in order to exclude rain and air by forming a continuous covering over the entire pile. The composition was normally thixotropic and included wax, tar or pitch or a polymer which provided a covering from one-quarter inch to one inch thick. It was necessary to break the covering in order to transfer or utilize the coal.

Berkowitz, in Canadian Patent 959783, described a method of treating low-rank coals which included heating the coal to a temperature (about 350° C.) by immersion in a liquid medium, causing pyrolytic material to diffuse from the interior to the surface of the coal particles and to plug the pores to prevent moisture reabsorption.

Wong disclosed in U.S. Pat. No. 4,461,624 a process of immersing coal in residuum having a softening point of at least 80° C., at a temperature from 240° C. to the decomposition temperature to boil off the moisture content and coat the coal particles within the immersion medium. This process has the disadvantages of providing a thick coating of treatment material on the coal particles which must be drained off of the particles.

It is an object of the present invention to obviate or mitigate the above-mentioned disadvantages.

Accordingly, the invention provides a method for improving the calorific value of wet particulate coal comprising:

(a) introducing wet coal into a heating zone at a controlled rate;

(b) contacting said wet coal with a heavy, viscous hydrocarbonaceous treatment material at a controlled rate in said heating zone;

(c) simultaneously intimately mixing said coal and said material and heating said material and said coal to a temperature within the range from about 200° C. to the lower of the decomposition temperature of the coal and the cracking temperature of the treatment material while moving said coal and material along said heating zone in a plug flow manner to obtain treated coal; and (d) cooling said treated coal; said treatment material having a softening point after said heating step, of at least 60° C.

The invention further provides a beneficiated coal product containing no more than substantially 5 percent moisture, and having an equilibrium moisture of no more than 10 percent, when made by the above process.

All references to percentages and ratios in this disclosure and claims are on a weight basis, unless otherwise indicated. Equilibrium moisture was measured by a test method equivalent to a modified ASTM D-1412. The alteration from the standard test method is that the coal was not pulverized before the 24-hour exposure to water. Because of the larger particle sizes, the measured equilibrium moisture level is consistently lower than that measured by the standard D-1412 test. However, pulverizing the test coal had to be avoided as it would negate the sealing effect of the coating process of the invention.

When the coal is charged into the heating zone, it is contacted by a controlled amount of treatment material. The water in the coal vapourizes to form a steam vapour and escapes from the pores of the coal. This steam vapour escapes into the treatment material surrounding the coal and causes it to foam. The foamed material has a larger surface area for contact with the coal particles, thus a thin film of treatment material on the coal particles is obtained. Also any fine dust particles are captured in the high surface area foamed material. The coal and treatment material are intimately mixed to ensure good and even coverage of the coal particles and are transported along the heating zone in a plug flow manner to ensure that controlled mixing and heating zones are maintained. When the coal is cooled, the collapse of internal water vapour pressure draws a plug of treatment material into the pores of the coal particles which solidifies there and checks reabsorption of moisture into the treated coal product.

Optionally, the coal particles are preheated in the heating zone prior to being contacted with treatment material. The temperature conditions in the inlet end of the heating zone and the time before contact of the particles with hydrocarbon material are chosen so that a steam blanket of vaporised liquid which was present in the coal surrounds each coal particle to protect each particle from oxidation. In the preheating step, the coal therefore loses only a minor proportion of its moisture content; the purpose of the preheating step is to raise the surface of the coal to a temperature above the softening point of the treatment material to obtain immediate adhesion between the treatment material and the coal particles. The still-partially-wet coal remains in the optional preheating zone for a time in the range from about 0.2 to 10 minutes, during which period a small portion of the moisture present in the coal is evaporated. Although the surface of the particles reaches a temperature sufficient for the treatment material to adhere to the particles, the centre of the particles can be at a considerably lower temperature because of the liquid still present in the particles. At least about 5% moisture must be present in the preheated coal particles when the treatment material is applied to ensure that a steam blanket is formed around the particles.

The heating zone is preferably at a temperature in the range of 500°–800° C., most preferably 700° C. near the inlet end and at a temperature in the range of 200°–300° C. at the outlet end. Preferably, the heating zone temperature at the location where the treatment material is added to the coal particles and initially mixed is selected so that the initial mix temperature is constant and about the boiling temperature of the water, e.g. 100° C. By maintaining a maximum temperature at the inlet end and a minimum temperature at the outlet end of the heating zone, maximum heat transfer is obtained at the beginning and breakdown of the hydrocarbon treatment material is inhibited at the end of the heating zone. The selection of the temperature so that the initial mix temperature is constant also inhibits breakdown of the treatment material.

The coals particularly suitable for beneficiation by the method of the invention include bituminous, subbituminous and lignitic coals having an equilibrium moisture of 5% or greater, preferably 12% or greater, as measured by the above-noted modified ASTM D-1412 test. The process can be used with low-rank coals that have been partially dried, by shortening the preheating step. It is not applicable to totally pre-dried coals, as oxidation of the coal may occur and because there is not a sufficient drop in internal pressure as the coal is cooled to draw plugs of treatment material into the pores. The coal particle size is in the range from about 0.07 cm, i.e. a 24-mesh screen, to about 3 cm and preferably in the size range from about 0.5 cm to 2 cm. The coal can comprise coal dust, which in the present specification designates sub-24-mesh particles. Alternatively, dust can be added to the treated hot coal before cooling, at which temperature the treated coal has sufficient tack to cause the dust to adhere to the hot coal particles. The dust can be applied without predrying or preferably can be pre-dried before being mixed with the treated coal. The ratio of dust to treating material can be selected by the skilled practitioner in the art without departing from the spirit of the invention, the upper limit of the dust:-treating material ratio depending upon the equilibrium moisture of the dust itself. A third method of utilizing dust, which is a by-product of the standard coal crushing operation, is to blend at least a portion of dust into the treatment material, whereby the dust acts as an extender for the treatment material. An appropriate level of dust in the treatment material can be determined by the person skilled in the art.

The treatment material applied to the particulate coal in the mixing step must have a softening point of at least substantially 60° C., and preferably 90° C. Alternatively, the coal treatment material can be hardened by the thermal treatment of the heating step of the invention to achieve a softening point of at least 60° C. by the time the treated coal product is cooled. At normal storage and transportation temperatures, the use of the hard, low-tack treatment material minimizes inter-particle adhesion and allows the bulk coal product to remain flowable throughout. The treatment material comprises a heavy hydrocarbonaceous oil, for example coal tar, solvent-precipitated asphalt, or a vacuum distillation residuum, for example tar, pitch, or straight-run or oxidized asphalt, made from conventional or heavy crude oil, from oil sands bitumen, or from upgraded heavy crudes or bitumens or mixtures of the above-mentioned residua; particularly suitable is the residuum of a hydrogen donor diluent hydrocracked oil sands bitumen. Alternatively, any of the above-noted treatment materials can be employed in the form of an emulsion, for example asphalt emulsion. In such form it can be easily handled and pumped prior to application to the preheated coal. The base residuum must nevertheless have the softening point characteristics discussed above.

Optionally, the treatment material can be preheated prior to being brought into contact with the wet coal particles. Preheating to a temperature above the softening point of the treatment material is advantageous when the treatment material is a residuum comprising substantially no water, because handling of the treatment material in the liquid state is simplified, compared to that of material in the solid state. Optionally, both the wet coal and the treatment material can be preheated prior to the contacting step.

If the treatment material is solid at the temperature of the contacting step, it is advantageously used in finely divided form, for example prills. Generally, however, the treatment material will be liquid at the contact temperature, either as a preheated residuum or as an aqueous dispersion of residuum. In this condition, the treatment material can be applied by dripping or spraying onto the wet coal particles as they move from the optional preheating zone to the main heating zone. The rate of application of the treatment material is controlled so that the final percentage content of the treatment material on the coal particles can be maintained at the desired level. The percentage of treatment material on the finished product must be sufficient to plug during the cooling step substantially all of the pores in the coal particles that can re-absorb water, but should be kept at the minimum possible amount for economic reasons, and is in the range from about 2% to 15%, preferably from about 2% to 5%. It is essential that the coal particles be intimately mixed during and after the addition of treatment material in order that full contact of the treatment material and the coal be obtained, but the entire surface of the particles need not be covered, so long as the pores are plugged as noted above.

The treated coal is heated in the main heating/mixing zone to a final temperature in the range from about 200° C. to the lower of the decomposition temperature of the coal, or the cracking temperature of the treating material. Generally, the decomposition temperature of many Western Canadian subbituminous coals and lignites will be in the range of 240° C. to 350° C. and that of many bituminous coals will be slightly higher. For many tars and pitches, thermal cracking begins at about 375° C. with consequent production of lower-boiling hydrocarbons, which reaction is to be avoided because it will both soften the treatment material in the final product and cause loss of valuable combustibles. On the other hand, thermal treatment at temperatures above 300° C. can harden, i.e. raise the softening point of, the treatment material during this step, as is known in the art. The coal remains in the main heating zone for a time in the range from 0.5 minutes to 20 minutes; the required residence time is directly related to the coal particle size and in particular to its moisture content, and inversely related to the treatment temperature. As an example, a residence time of 10 minutes in a batch operation has been found suitable to obtain a product having 0.5% moisture where the main heating zone was maintained at 200° C. and the coal particles averaged 0.7 cm in diameter. A product containing no more than 5%, preferably no more than 1% moisture can be obtained by adjusting the process variables within the ranges noted above. At least as important as the actual moisture of the product directly after the cooling, is the equilibrium moisture level that the product will attain when exposed to a humid environment. By plugging substantially all of the pores of the coal particles, the process of the invention prevents the reabsorption of moisture into the particles, and attains an equilibrium moisture level of no more than about 15%, preferably lower than 10%, representing a reduction of 20% to 50% or better in the moisture absorption of the beneficiated coal product.

The process of the invention can be carried out in relatively simple equipment. The optional preheating zone and the heating zone can be continuous or separated. It is particularly advantageous to employ a rotary kiln having longitudinal internal flanges or lifters. These lifters ensure that the coal particles are agitated during the mixing and heating steps while the kiln is being rotated; the rotational speed is adjusted to obtain the required coal particle residence time, and is advantageously from about 1 to 20 r.p.m. Where a rotary kiln provides preheating and heating zones, it is convenient to introduce the treatment material part way through the length of the kiln, at a point where the temperature of the coal particles is raised to at least the softening point of the treatment material, but where the coal is not fully dried. Generally the location of means to introduce the treatment material will be closer to the inlet of the kiln than to the outlet. Significantly more heat is needed to dry the coal particles than to preheat them. When desirable, for example when using an aqueous asphalt dispersion, the means to introduce the treatment material can be adjacent the inlet of the kiln. When the treatment material is in the liquid state, it can be introduced by suitable means for handling liquids, for example sparging tubes, nozzles or simple drip tubes. It is not necessary to create a finely divided spray of treatment material in order to obtain good distribution of the treatment material among the coal particles because tumbling during the main heating step that allows the coal particles to be thoroughly heated and dried also achieves a sufficient mixing action. The rate of application of treatment material is controlled by any suitable means, for example a flow meter, or a controlled-rate positive displacement pump. Heat can be supplied by any suitable means and is preferably supplied by hot combustion gases directed through the interior of the kiln. The wet particulate coal to be treated is fed by known suitable feed means at a controlled rate into the inlet of the kiln, for example an auger, or a vibrating conveyor.

The invention will be further described with reference to the following drawings in which.

Figure 1:
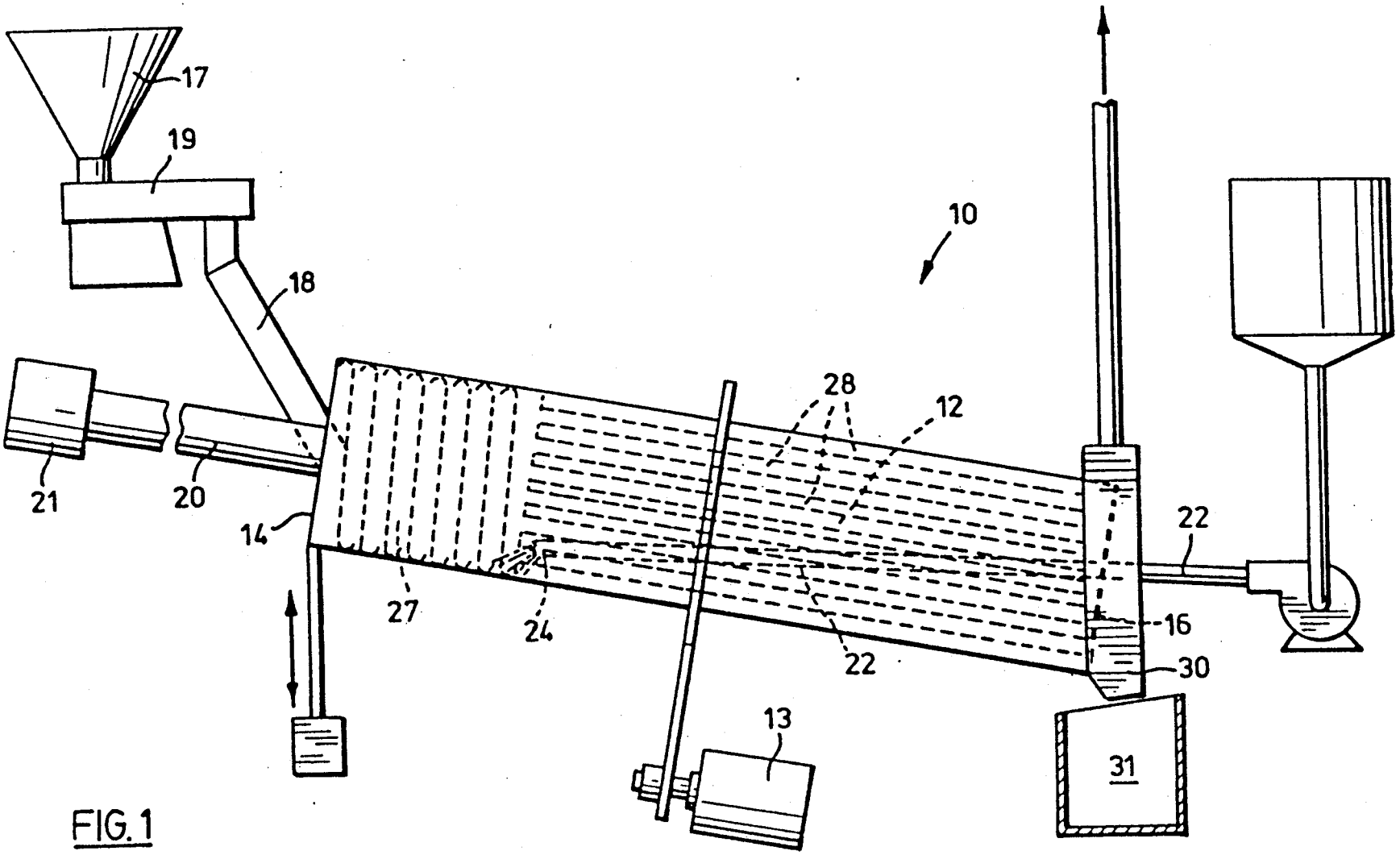
FIG. 1 is a diagramatic side view of a rotary kiln.

As can be seen in FIG. 1, rotary kiln 10 has a cylindrical rotating portion 12 or heating zone rotated by a variable speed drive unit 13 between two fixed ends, an inlet end 14 and an outlet end 16.

At the inlet end 14 a coal inlet 18 for introducing coal into the kiln is located. This coal inlet includes a feed hopper 17 followed by a vibratory feeder 19. Adjacent this coal inlet 18 is a hot combustion gas inlet 20 for introducing hot combustion gases into the kiln. This gas inlet is associated with a gas burner 21. An asphalt pipe 22 extends into the heating zone 12 and terminates at a spray nozzle 24 located downstream from the inlet end 14. On the inner surface 26 of the heating zone 12 near the inlet end 14 is located a spiral flight 27 followed by a plurality of spaced, internal flanges 28 whose size and flight angles are chosen to convey the coal particles in a plug flow manner along the heating zone 12. At the outlet end of the kiln 10 a treated coal outlet 30 and a coal collection bin 31 are located.

Figure 2:
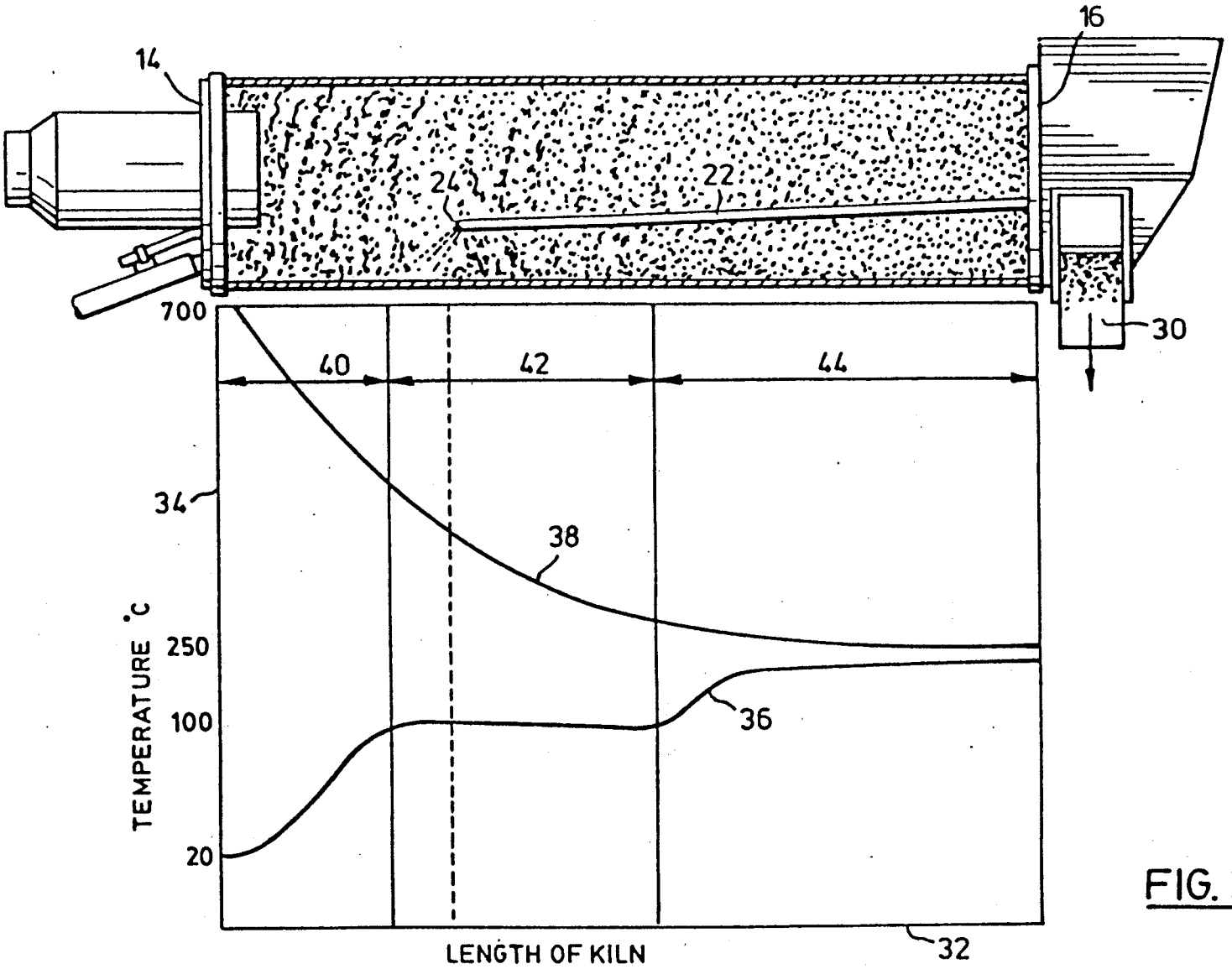
FIG. 2 is a temperature versus length of kiln graph.

FIG. 2 is a graph showing the temperature profiles for the kiln and the coal relative to the parts of the kiln. The abscissa 32 is related to the length of the kiln and the ordinate 34 is related to the temperature. The lower line 36 on the graph represents the coal and the coal/treatment material mix temperature profile, and the upper line 38 on the graph represents the temperature profile of the gases in the kiln.

Coal initially increases in temperature from ambient temperature to about 100° C. in a coal heating region 40. The gases in the kiln are initially at about 700° C. and decrease in temperature in this region. The coal is then admixed with treatment material in an initial mixing region 42. In this region the temperature conditions in the kiln are such that the mix temperature is kept constant at about 100° C. In a final mixing region 44 of the kiln the gas temperature gradually decreases and the mix temperature gradually increases. At the outlet end, the gas temperature is only a few degrees higher than the mix temperature and is about 250° C.

In operation, coal at room temperature is charged into the inlet end 14 of the kiln through coal inlet 18. The kiln is heated by the combustion gases so that the temperature is about 700° C. at the inlet end of the heating zone and decreases gradually along the length of the kiln a minimum temperature of about 250° C. at the outlet end of the heating zone. This can be seen in FIG. 2. Thus there is a high heat transfer rate between the coal particles and the gases in the coal heating region 40. Water trapped in the coal particles boils and escapes through the pores of the particles to form a steam jacket around each particle in this region 40. These steam jackets effectively inhibit oxidation of the coal particles.

Hydrocarbon treatment material is then sprayed at a controlled rate onto the surface of the particles in the initial mixing region 42. By contacting each particle with a controlled minimum amount of treatment material, the steam that escapes from the coal boils through the treatment material resulting in foamed treatment material around the coal. The foamed treatment material has a greater surface area with which to contact the coal, therefore a thin film coating of treatment material on the coal is obtained.

As discussed above and shown in FIG. 2, the temperature conditions in the kiln in the initial mixing region 42 are selected so that the initial mixing temperature is constant. A significant amount of breakdown and coking of the hydrocarbon materials therefore does not occur in this region. The temperature difference between the mix and the kiln decreases along the length of the kiln in the final mixing zone 44 to ensure that the coal mixture is not overheated. The amount of moisture removed from the coal particles depends on the residence time in the kiln and the length of the kiln. When the particles leave the kiln, they are cooled.

Coal particles having a thin film of treatment material are thereby obtained in a relatively short amount of time. Also, because of the controlled addition of the treatment material, there is no need to drain any excess treatment material.

The invention will be further described with reference to the following examples.

EXAMPLES 1-3

A wet coal treatment was carried out according to the invention in a cylindrical drum 15 cm in diameter and 20 cm long fitted with 8 longitudinal lifting flights 1.2 cm in height equally spaced around the inside surface of the drum. The ends of the drum were closed except for a 5 cm hole centered in each end; the drum was rotated at 20 r.p.m. and heated by an external flame so adjusted that the inside surface of the drum was 200° C. when empty. A charge of 100 g of bituminous coal in the particle size range from 6.4 mm to 9.5 mm (0.25 in. to 0.375 in.) and having an actual moisture content of 5.4% and an equilibrium moisture level of 8.8% was rotated in the drum for a period of 0.5 minutes, then a pitch having a softening point of 84° C. was preheated to 100° C. and sprayed into the rotating drum through a perforated pipe; during the spraying, a measured quantity of pitch was applied to yield the appropriate percentage of pitch on the finished product as indicated in Table 1. The mixture was allowed to tumble for a further heating period of 10 minutes. The heat source was removed and the product samples were cooled in the drum, and the actual moisture contents and equilibrium moisture levels were determined. The results are shown in Table 1.

TABLE 1

| | | Surface Heating | | |
|---|---|---|---|---|
| Example | Pitch Weight | Heating Temperature | Product Moisture Content | Equilibrium Moisture Reduction |
| 1 | 3.2% | 180° C. | 0.2% | 34.1% |
| 2 | 2.1% | 180° C. | 0.1% | 13.6% |
| 3 | 3.7% | 180° C. | 0.01% | 18.2% |

EXAMPLES 4-7

Further tests were done in a continuous mode in a drum having a downward slope of 1 in 20 from the inlet to the outlet. The inner surface of the drum contained a 1.2 cm high, 13 cm long spiral flight at the inlet end to carry the coal beyond the flame front. The remaining 47 cm contained 17 longitudinal lifting flights 1.2 cm in height equally spaced around the inside circumference of the drum to tumble the coal. Hot gases from an open flame were passed through the drum and a minor amount of heat was supplied by an electric radiant heater mounted above the drum. The feed, a bituminous coal grading from 6.4 mm to 9.5 mm and having an actual moisture content of 8.97% and an equilibrium moisture level of 13.5%, was charged to the inlet end of the drum at the rate shown in Table 2. The pitch of Examples 1-3 was applied by dripping through the end of a tube placed 20 cm from the inlet of the drum. Thus the approximate preheating time was 3 min in Example 4, 5 and 7, and 1.5 minutes in Example 6, the remainder of the time being combined heating/mixing time. The product temperature was measured at the outlet end of the drum and the product was cooled and analysed for equilibrium moisture and pitch content, with the results shown in Table 2. Without any attempt to optimize the method, nevertheless a significant reduction in the ability of the product coal to absorb moisture was achieved.

TABLE 2

| | | | Hot Gas Method | | | |
|---|---|---|---|---|---|---|
| Ex | Product Temperature | Drum RPM | Conditions Feed Rate | Residence Time | Pitch Content | Reduction Equilibrium |
| 4 | 256° C. | 1.75 | 6.5 | 21.0 min | 3.38% | 39.0% |
| 5 | 306° C. | 1.75 | 6.5 | 21.0 min | 4.99 | 46.6 |
| 6 | 260° C. | 3.50 | 8.4 | 10.6 min | 4.81 | 23.0 |
| 7 | 290° C. | 1.75 | 8.4 | 21.0 min | 1.96 | 31.5 |

EXAMPLES 8-11

Additional tests were done in a continuous mode in a drum having a downward slope of 0.375 inch in 24 inches from the inlet to the outlet. The inner surface of the drum contained a spiral flight at the inlet end to carry the coal beyond the flame front followed by 16 longitudinal lifting flights 1 inch in height equally spaced around the inside circumference of the drum to tumble the coal. Hot gases from an open flame were passed through the drum. The feed, a bituminous coal in the size range 16 mesh×½ inch having an equilibrium moisture level of 13.45% in runs 8 and 9 and 11.20% in runs 10 and 11, was charged to the inlet end of the drum at the rate shown in Table 3. The pitch of Examples 8-11 was applied by dripping through the end of a tube placed 16 cm from the inlet of the drum. The pitch used was propane deasphalted (CPDA) resin with a softening point of 55° C., and a viscosity of 105 cSt at 175° C. and of 295 cSt at 150° C. The product temperature was measured at the outlet end of the drum and the product was cooled and analysed for moisture content, equilibrium moisture and resin content, with the results shown in Table 3. A significant reduction in the ability of the product coal to absorb moisture was achieved.

TABLE 3

| | | | | | Test Results | | | |
|---|---|---|---|---|---|---|---|---|
| | | Coal | Temperature °C. | | | PDA | Equilibrium | Equilibrium Moisture |
| EX | Drum RPM | Feed kg/h | Coating Zone | Exit | Moisture % | Resid % | Moisture % | Reduction % |
| 8 | 5 | 19.0 | 222 | 235 | 2.06 | 1.88 | 6.40 | 52.4 |
| 9 | 9 | 16.5 | 278 | 253 | 0.61 | 2.26 | 6.08 | 54.8 |
| 10 | 9 | 15.8 | | 224 | 0.59 | 3.00 | 4.98 | 55.5 |
| 11 | 9 | 18.5 | | 200 | 1.26 | 2.94 | 5.15 | 54.0 |

We claim:

1. A method for improving the calorific value of wet particulate coal comprising the steps of:

(a) introducing wet coal at a controlled rate into a heating zone, said heating zone comprising an upstream end having a temperature of from about 500° to about 800° C. and a downstream end having a temperature of from about 200° to about 300° C.;

(b) contacting said wet coal with a heavy, viscous hydrocarbonaceous treatment material at a controlled rate in said heating zone;

(c) simultaneously intimately mixing said coal and said material and heating said coal and said material to a temperature within the range of from about 200° C. to the lower of the decomposition temperature of the coal and the cracking temperature of the treatment material while moving said coal and material along said heating zone in a plug flow manner to obtain treated coal; and (d) cooling said treated coal; said treatment material having a softening point after said heating step, of at least 60° C.

2. A method as claimed in claim 1 wherein said treatment material is selected from the group consisting of: distillation residuum of crude oil or oil sands bitumen or heavy oil; distillation residuum of upgraded oil sands bitumen or heavy oil; solvent-precipitated asphalt; coal tar residue; mixtures thereof; and an aqueous dispersion of any of said treatment materials.

3. A method as claimed in claim 1 wherein said treatment material is preheated to a temperature above its softening point prior to contacting with said wet coal in step (b).

4. A method as claimed in claim 3 wherein the temperature in said heating zone in the region wherein step (b) is carried out is selected so that the initial temperature of said coal and material is the boiling temperature of water.

5. A method as claimed in claim 1 wherein said wet coal is preheated to the boiling temperature of water prior to contacting in step (b), whereby said preheated coal contains no less than 5 percent moisture immediately prior to said contacting step (b).

6. A method as claimed in claim 3 wherein said wet coal is preheated to a temperature above the softening point of said treatment material and below about 200° C. prior to contacting in step (b), whereby said preheated coal contains no less than 5 percent moisture immediately prior to said contacting step (b).

7. A method as claimed in claim 1 wherein said treatment material comprises vacuum residuum derived from heavy oil or oil sands bitumen.

8. A method as claimed in claim 1 wherein said treatment material is applied by spraying.

9. A method as claimed in claim 1 wherein said wet coal contains at least 8 percent moisture.

10. A method as claimed in claim 1 wherein said treated coal product contains no more than 3 percent moisture.

11. A method as claimed in claim 1 wherein said wet particulate coal is selected from the group consisting of butuminous coal, subbituminous coal and lignite.

12. A method as claimed in claim 1 wherein the heat supplied in step (c) is supplied by passing hot gases through a vessel containing said coal.

13. A method as claimed in claim 12 wherein said vessel is a rotating kiln.

14. A method as claimed in claim 1 wherein the coal product comprises from one percent to five percent of said treatment material.

15. A method as claimed in claim 1 wherein said wet coal has an equilibrium moisture of at least 12%.

16. A method as claimed in claim 1 comprising the additional step of admixing after said heating step and before said cooling step, no more than 20% of predried coal particles smaller than 0.07 cm.

* * * * *